United States Patent [19]

Mascia

[11] 4,088,019

[45] May 9, 1978

[54] LEEWAY ANGLE INDICATOR

[76] Inventor: Anthony Mascia, 445 Westchester Ave., Port Chester, N.Y. 10573

[21] Appl. No.: 805,112

[22] Filed: Jun. 9, 1977

[51] Int. Cl.[2] ..... G01C 21/00

[52] U.S. Cl. ..... 73/180

[58] Field of Search ..... 73/180, 188, 189; 114/144 R, 144 C

[56] References Cited

U.S. PATENT DOCUMENTS

| | | | |
|---|---|---|---|
| 7,912 | 1/1851 | Wilder | 73/180 |
| 190,045 | 4/1877 | Iffland | 73/180 |
| 1,777,869 | 5/1876 | McNabb | 73/180 |
| 2,818,730 | 1/1958 | Giannini et al. | 73/180 |
| 3,475,957 | 11/1969 | Hiszpanski | 73/180 |

OTHER PUBLICATIONS

Marchay "Sailing Theory and Practice" 1964 pp. 312–313 pub. by Dodd Mead & Co.

*Primary Examiner*—Herbert Goldstein

*Attorney, Agent, or Firm*—Woodcock, Washburn, Kurtz & Mackiewicz

[57] ABSTRACT

A system which indicates the true leeway angle of a vessel, regardless of the heel of the vessel. A generally vertically-extending vane has its lowermost end submersed in the water in which the vessel is floating. The vane is rotatably journaled in a support, and an indicator attached to the upper end thereof for indicating the angle of the vane with respect to the vessel. The support is in turn pivotally mounted along a generally horizontal axis. A servo system is coupled to the vane support and serves to keep the vane aligned in a true vertical orientation.

A speed sensing mechanism may be associated with the vane for obtaining information regarding the speed of the vessel.

13 Claims, 6 Drawing Figures

LEEWAY ANGLE INDICATOR

BACKGROUND OF THE INVENTION

The present invention relates to performance measuring equipment for sailboats, and more particularly to improved means for determining leeway angle and vessel speed.

In the thousands of years that man has been sailing, the only sure way of measuring sailing performance has occurred when one vessel tried to escape from another. The captains of both vessels would do everything possible to exploit the full potential of their ships in an attempt to either evade or capture the other. This method of evaluating sailboat performance is still used today. While it is only a measure of relative performance, the information which is gleaned regarding sail settings can be recorded for use in subsequent, similar situations.

The above-described method is of little use in determining absolute performance, however. The absolute performance of a sailboat may be defined as its velocity related only to true wind velocity. Herein it should be noted that the term "velocity" denotes a vector or quantity having both magnitude and direction.

While other parameters affect boat performance, most of them can be related to true wind velocity and other known values, if desired. Absolute performance can be determined on board a sailboat only if three vectors are known. These are (a) apparent wind velocity; (b) boat velocity; and (c) current velocity.

Of the foregoing factors, current velocity is usually not measured on baord a boat or ship. Test runs of the vessel are typically made in an area where currents are minimal, or of known velocity.

Apparent wind velocity is measured in relation to the longitudinal center line of the boat. Boat speed is measured (usually inaccurately due to the hull curves and heel angle) parallel to the longitudinal center line of the boat. According to prior art techniques, the accurate measurement of boat velocity required the use of expensive, elaborate equipment which, when used, was done so only on large expansive vessels.

In the past many efforts have been made to provide means for indicating the leeway of a vessel. In modern times sophisticated systems have been devised for accurate navigation; however, such systems are commonly too complex, and hence too expensive, for use in small privately owned boats. Further, such systems are ordinarily comprised by permanent installations and cannot easily be placed on a vessel to gather data for properly trimming the vessel.

Such devices as are now known, and adaptable for use in small vessels, ordinarily include a vane journaled upon a generally vertically-extending shaft. The shaft is conventionally journaled within a tube or other support fixed to the hull of the vessel. In some instances the shaft of the vane extends upwardly through the vessel, the leeway-indicating vane lying below the vessel in the region of the keel so that leeway of the vessel will cause rotation of the vane-carrying shaft. This results in the production of an indication at the bridge of a ship, such as the motion of a pointer or the like. For sailing craft, which commonly exhibit substantial heel, a significant error is introduced in such leeway indicating apparatus due to the heel of the craft. In particular, as the heel increases the deflection of the vane due to leeway decreases so that the further heeled a vessel is, the greater the error in indicated leeway. This is particularly disadvantageous inasmuch as sailing craft are conventionally heeled over furthest when the leeway is at a maximum. Moreover, the present inventor has found that a substantial error occurs whether a leeway indicator is constrained to heel with the vessel to which it is mounted or gimballed and allowed to ride free in the water.

Accordingly, it will be understood that it would be highly desirable to provide a compact leeway measuring system for use with small craft, and which overcomes the deficiencies inherent in prior art leeway measuring systems and which provides a more accurate indication of leeway.

It is therefore an object of the present invention to provide an improved leeway indicator.

Another object is to provide a leeway indicator which indicates true leeway despite the heel of the vessel to which it is mounted.

Still another object is to provide a leeway indicating system which is compact enough to be temporarily attached to small vessels for obtaining information regarding their operation.

Yet another object is to provide an improved sensing apparatus for developing speed and leeway data to assist the trimming and navigation of a sailing craft.

Yet another object is to provide a leeway measuring system including meals for maintaining a leeway vane in a substantially vertical orientation.

SUMMARY OF THE INVENTION

Briefly stated, in accordance with one aspect of the invention the foregoing objects are achieved by providing a submersible vane including a generally vertically-extending mast and means to allow the angular rotation of the mast. A mounting for the system allowing the mast to pivot about a generally horizontal axis is also provided, along with motive means for urging the axis of rotation of the vane to a true vertical position regardless of the attitude of the vessel or the strength of cross currents. In a preferred embodiment the attitude control means comprises a servomechanism which senses the deviations from true vertical in the attitude of the vane, and constantly forces the vane toward a true vertical position. Sensing means coupled to the vane mast produce an indication of the angular position of the vane with respect to the vessel, thus indicating true leeway. In one embodiment, speed indicating means are provided on the vane.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
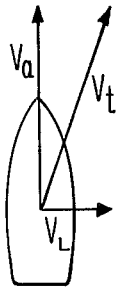
FIG. 1 is a vectorial presentation indicating vessel motion.

FIG. 1 illustrates the effect of leeway upon a vessel, and its relation to the apparent orientation of the vessel. The apparent motion vector $V_a$ represents the motion of the vessel in the direction in which it is headed, and thus the direction in which an observer on the vessel would subjectively expect the vessel to move. Vector $V_L$ represents the leeway undergone by the vessel, which may be quite substantial under some conditions. The side thrust of wind against the vessel causes it to have a certain velocity $V_L$ as shown. As will be recognized by those skilled in the art, the true velocity $V_t$ is the vector sum of $V_a$ and $V_L$. Hence, in order to know the true direction of the craft it is necessary to ascertain the leeway of "sideslip" of the vessel through the water.

The conventional approach to determining leeway has been to provide a vane or the like at the lower end of a generally vertical mast, which is thrust beneath the surface of the water so that the sideslip or leeway deflects the vane and causes the mast to rotate.

Figure 2:
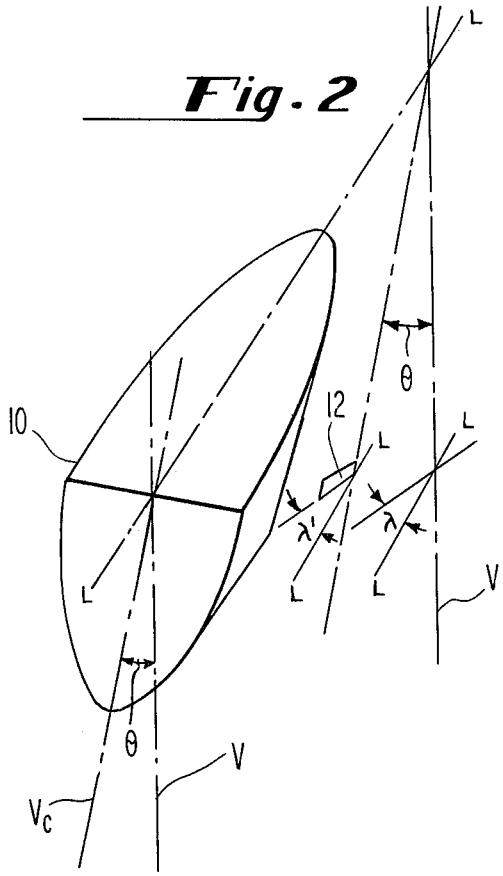
FIG. 2 is a schematic diagram illustrating principles of the invention.

In FIG. 2 there is shown in idealized form a vessel 10 heeling at an angle $\theta$ with respect to true vertical, represented by line segment V. In the past leeway indicators have included a vane member 12 attached to a mast which was journaled in a mounting fixedly attached to vessel 10. The angle $\lambda'$ formed by the vane member 12 with respect to a line segment L parallel to the longitudinal axis of the vessel was then taken to be the leeway angle of the craft. However, it has been determined by the present inventor that this assumption is not accurate. Indeed, the further the craft heels, the greater the error between the indicated angle $\lambda'$ and the true leeway angle, herein designated $\lambda$.

The error is only made indeterminate, and not eliminated, by pivoting or gimballing the vane assembly so that it can swing free of the vessel hull. This is true because the lateral force component due to the sideslip or leeway will deflect the now-free vane assembly some distance from true vertical.

Figure 3:
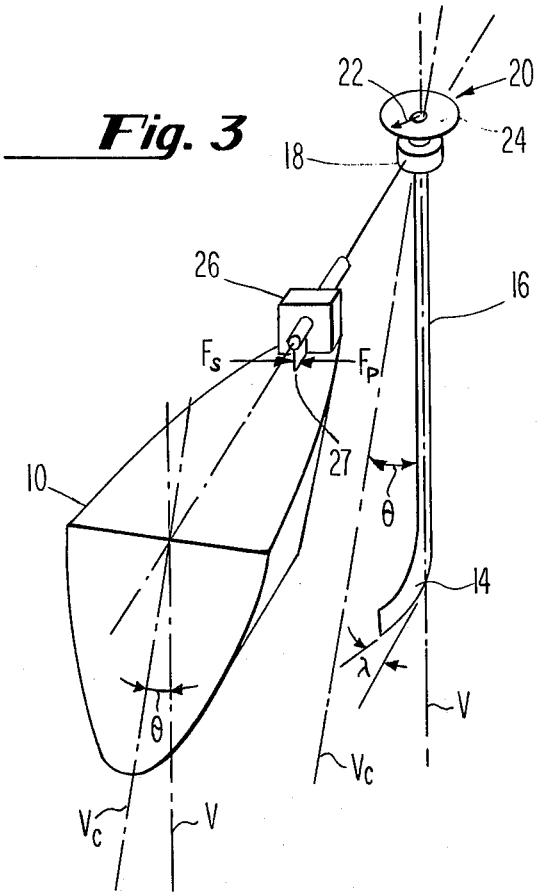
FIG. 3 is an idealized diagram illustrating aspects of positioning an element of the system.

Turning now to FIG. 3 there is shown in idealized form a mechanism for obtaining a measure of the true leeway angle of a vessel. A vane member 14 fixedly attached to the lowermost end of a mast 16, which extends upwardly above the surface of the water (not shown) in which vessel 10 floats to a vertical pivot means 18. The vertical pivot means may simply comprise a bearing or the like which allows the vane assembly to rotate freely under the influence of the pressure of the water through which the vessel is moving. Indicator means 20 are coupled to the upper end of mast 16, and in the illustrated form simply comprise a pointer or the like 22 affixed to the mast. The pointer rotates over a surface 24 which may be scribed with appropriate characters for indicting the angle $\lambda$ at which vane member 14 is deflected.

The vertical pivot means 18 extends rearwardly toward the bow of the vessel and is received within a horizontal pivot means 26, which may again comprise a bearing or the like which rotatably receives the vertical pivot means so as to allow the vane assembly to move with respect to the vertical center line $V_c$ of the vessel.

In carrying out the teachings of the present invention, a port-directed force $F_p$ and a starboard-directed force $F_s$ are selectively applied to the illustrated assembly for causing the vane assembly to adopt a substantially vertical orientation, regardless of the heel angle $\theta$ of the craft or the side thrust due to hull slippage. In the present illustration, simplified for the purpose of ease in explanation, the various forces are indicated as arrows bearing upon an arm 27 extending radially from the vertical pivot means which is journaled within horizontal pivot means 26. A control system (not shown) including a source of true vertical reference information, selectively applies forces $F_p$ or $F_s$ as required in order to maintain the vane assembly along a true vertical orientation. Accordingly, the indicated leeway angle is in fact the actual leeway angle $\lambda$, regardless of the heel of the craft or the presence of slippage. Further, with the information available from the illustrated system the actual heel angle of the craft may conveniently be divined.

Figure 4:
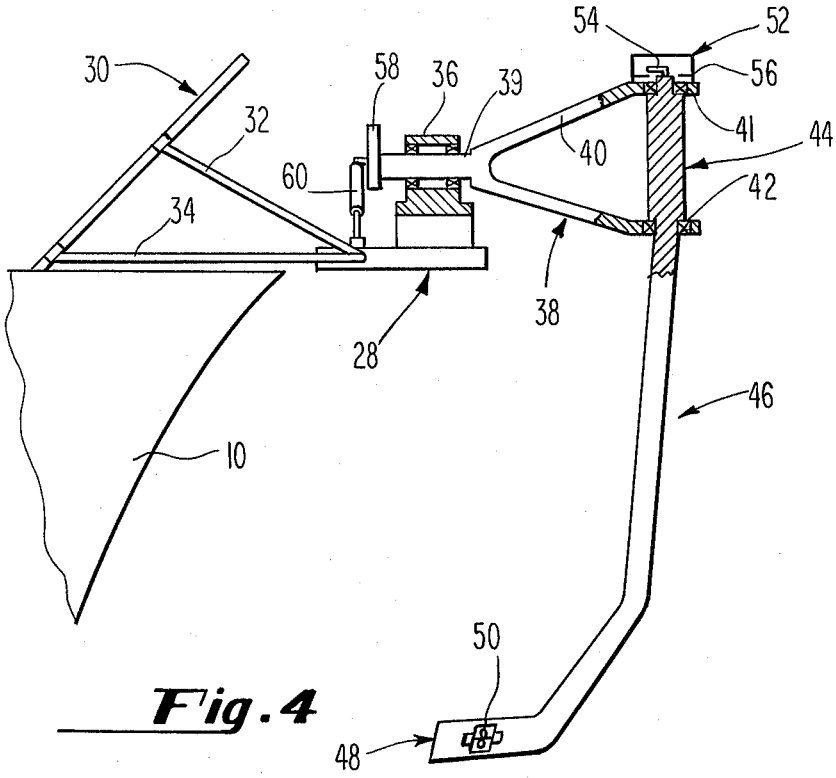
FIG. 4 is a cross-sectional diagram illustrating construction of one aspect of the invention.

FIG. 4 illustrates further structural details of a presently preferred embodiment of the invention, showing an application of the invention in which it is temporarily mounted upon a vessel 10 for obtaining information regarding the vessel's sailing characteristics. A base member 28 is fixedly attached to the vessel bow pulpit, a portion of which is represented at 30, by means of clamps 32, 34. The base member then may, for present purposes, be considered to be part and parcel of the vessel inasmuch as the two are rigidly interconnected.

The horizontal pivot means is comprised by a bearing block 36 which is affixed to the base 28. Journaled within the bearing block is a vertical pivot means 38, comprising a rearwardly-extending shaft 39 journaled within bearings in the bearing block, and bifurcated, forwardly-extending portion 40 carring a pair of spaced-apart bearings 41, 42 in which is journaled the mast 44 of vane assembly 46.

The lower end of the vane assembly terminates in a vane member 48 which may advantageously exhibit a rounded or streamlined form as shown so as to impede forward motion of the vessel as little as possible. In a preferred embodiment a propeller 50 is journaled upon the vane assembly so as to provide an indication of the relative speed of the assembly through the water. By thus placing the propeller in advance of the bow of the vessel it encounters undisturbed water, and its speed of rotation provides an accurate measure of the relative speed of the vessel.

At the uppermost end of mast 44 are means for indicating the anglular position of the vane member 48. This means, herein indicated as a potentiometer 52, may include a rotary wiper 54 fixedly attached to the uppermost end of the mast, and a peripheral resistive element 56 which is traversed by wiper 54 in response to the rotation of mast 44 with respect to the supporting member 38. In this manner an electrical signal may be produced and transmitted through appropriate wiring (not shown) to a meter or the like for producing an indication of true leeway angle.

As has been discussed above, in accordance with the analysis of the present inventor it is desirable to maintain the pivotal axis of the vane assembly 46 in a true vertical direction. Inasmuch as vane assemblies may have different forms, advantageously including a "swept back" lower portion as shown in the Figure, it should be recognized that it is the axis of rotation of the mast, rather than the orientation of various elements of the assembly, which should be aligned in a vertical direction. By disassociating the mast support from fixed placement upon the vessel, the vane assembly can thus be freed to adopt a vertical position despite the heel of the vessel.

Given the foregoing, it would seem that a straightforward solution might be obtained by appropriately weighting or counterbalancing the vane assembly so that it might adopt a vertical orientation unaffected by the attitude of the base (vessel) to which it is mounted. However further study of the dynamics of the mechanism has shown that no matter how balanced or weighted, the vane assembly will not achieve a true vertical position in use so long as there is any appreciable crosscurrent or leeway. Thus, under conditions where it is desired to measure leeway, the very phenomenon which is to be measured becomes a source of error.

In order to obviate this effect, the present invention includes a servomechanism for maintaining vane assembly 46 in a vertical orientation. The servomechanism is substantially housed within a casing 58, and includes a motive mechanism which may comprise a pair of hydraulic cylinders. In FIG. 4 one of the cylinders 60 is visible, and extends from a point on casing 58 to the base 28 which is mounted to the hull of the vessel 10.

Figure 5:
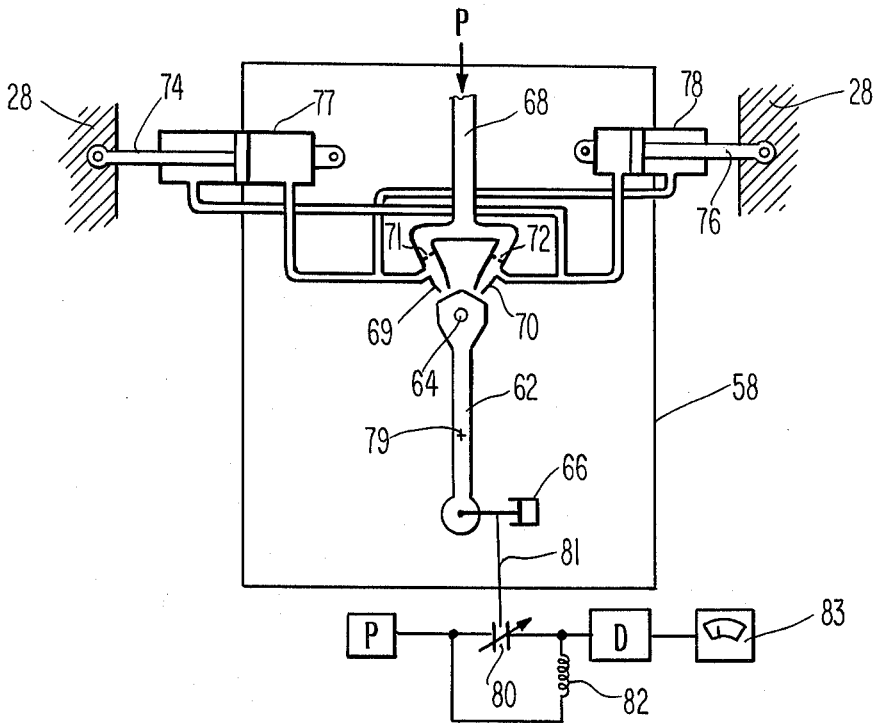
FIG. 5 is an idealized drawing illustrating a portion of an attitude control system.

FIG. 5 shows in further detail the workings of a servomechanism which is adaptable for use with the present system. A pendulum 62 is journaled on a shaft 64 mounted to a wall of casing 58 which is, in turn, fixedly attached to the end of shaft 39. A bearing 64 extends from the casing wall in a generally horizontal position. The lowermost, massy end of the pendulum 62 is advantageously coupled to a damper 66 to avoid repeated oscillation in response to the motion of the vessel to which the system is mounted. A source of pneumatic pressure (not shown), which may comprise a compressed air cylinder and regulator is coupled to an inlet line 68 which extends to a pair of sensing nozzles 69, 70 directed toward surfaces at the upper end of pendulum 62. The pendulum and nozzles thus serve to provide a flapper valve so that the relative pressures within nozzles 69, 70 are directly related to the orientation of the pendulum with respect to the nozzle assembly. Restrictions 71, 72 are provided within the nozzle assemblies for limiting the flow of air therethrough. While a pneumatic system is contemplated in the Figure, it will readily be seen that with appropriate valving changes an hydraulic system might also be used.

Pressure from port nozzle 69 is coupled to the starboard side of the pistons 74, 76 of cylinders 77, 78 respectively. In like manner pressure from nozzle 70 is coupled to the port sides of the pistons of the same cylinders. The fixed or casing portions of the cylinders are coupled directly to casing 58 as shown, and are therefore coupled to the vertical pivot means which supports the vane assembly 46. Regardless of the actual pivot or joint assembly selected for use with the vane, the salient point is that the attitude control system is coupled to the vane assembly in such a manner as to control its orientation so that the vane remains vertical while undergoing rotation.

The pistons of cylinders 77 and 78 are coupled to the base 28 which is in turn fixed to the hull of a vessel. The manner of mounting of the pistons in unimportant, as long as they are coupled in some fashion to the vessel so that they can cause rotation of mounting base 58 with respect to the vessel. In this manner the motive system comprised by the cylinders keeps the casing 58, and accordingly the vane assembly, in a fixed vertical orientation. In the illustrated embodiment base 58 may comprise a rigid plate or the like which is affixed to the axial end of pivot means 38, turning upon the horizontal axis 79 of the pivot means defined by its location within horizontal pivot means 36. As a still further accoutrement to the illustrated system a variable capacitor 80 is coupled to pendulum 62 by means of an appropriate slider arm 81. The capacitor is coupled, along with inductor 82, in series with an appropriate source of pulses P. The frequency arising in the resonant circuit is displayed upon the scale of a meter 83 or is counted and averaged over a period of time, and thus represents the attitude of pendulum 62 with respect to the hull of the vessel. The heel of the vessel can thus be ascertained to aid in data reduction and the like.

In operation, as the lowermost end of the vane assembly is deflected to starboard the base 58 will exhibit a counterclockwise motion with respect to pendulum 62. The upper faces of the pendulum will approach nozzle 69 and depart from nozzle 70 so that increasing pressure occurs within nozzle 69 while the pressure within nozzle 70 diminishes. This effects an imbalance upon the pressures across the various pistons, causing an increase at the starboard sides of the pistons. This tends to cause a clockwise rotation of base 58 and thus a self-correcting action. In this manner, the illustrated servomechanism will continuously operate to maintain the vane assembly in alignment with true vertical, as evidenced by the position of pendulum 62.

Figure 6:
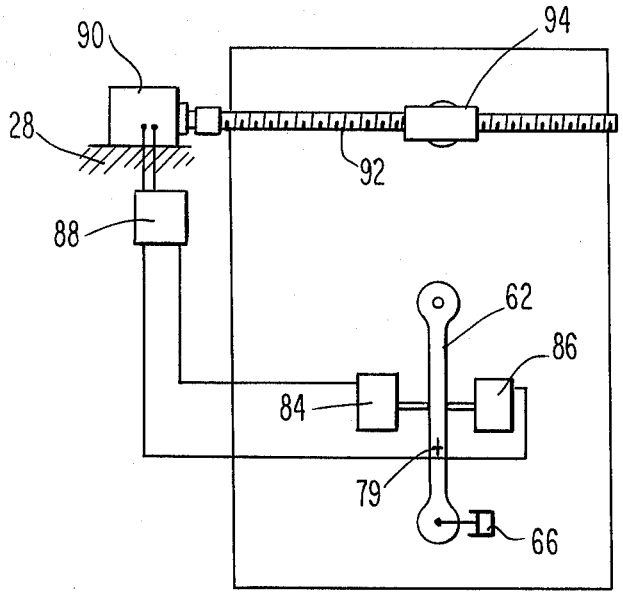
FIG. 6 illustrates the construction of another embodiment of the attitude control system.

FIG. 6 depicts an electrical execution of the servomechanism of FIG. 5. Pendulum 62, provided with a damping means 66, is flanked by a pair of electrical microswitches or the like 84, 86. The switches are coupled through appropriate wiring to a motor control 88 which in turn controls the operation of drive motor 90. A lead screw 92 is coupled to the shaft of the motor and is threadedly received by a ball nut or the like 94 which is pivotally connected to casing 58. As the vane assembly to which the base is connected heels one way or the other, one of the microswitches 84, 86 is contacted by pendulum 62. If, in the above example, the lowermost end of the vane is deflected to starboard to cause a generally counterclockwise rotation of base 58 about axis 79 pendulum 62 will more closely approach port switch 84, closing the switch to cause controller 88 to energize motor 90 so that the lead screw retreats from within ball nut 94. This forces the nut away from the motor and effects a clockwise correctional motion of base 58. Conversely, motion of the vane assembly in a direction opposite that described above would give rise to actuation of switch 86 and the energization of motor 90 in the opposite direction. Also, while not shown in FIG. 6, a simple circuit such as that of FIG. 5 may readily be coupled to the pendulum for providing an indication of vessel heel.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. Apparatus for ascertaining the true leeway angle of a moving vessel, comprising:

a submersible vane;

vertical pivot means for rotatably supporting said vane and defining a first axis of rotation thereof;

horizontal pivot means for rotatably supporting said vane;

attitude control means coupled to said vane for maintaining said first axis of rotation of said vane in a vertical plane regardless of variations in the attitude of the vessel; and means for producing a manifestation of the leeway angle of the vessel as a function of the angular dispostion said vane.

2. Apparatus according to claim 1, wherein said submersible vane comprises an elongate mast and a deflectible vane member disposed at one end thereof.

3. Apparatus according to claim 2, wherein said vertical pivot means is rotatably supported in said horizontal pivot means for allowing the attitude of said elongate mast to vary with respect to the vessel.

4. Apparatus according to claim 3, wherein said attitude control means includes motive means for controllably determining the attitude of said vane means with respect to the vessel.

5. Apparatus according to claim 4, wherein said attitude control means comprises a servo control including a vertical reference means for controlling the operation of said motive means.

6. Apparatus according to claim 5, wherein said vertical reference means comprises a pendulum.

7. Apparatus according to claim 6, wherein said servo control comprises a fluid pressure system.

8. Apparatus according to claim 7, wherein said servo control comprises a pneumatic control system.

9. Apparatus according to claim 6, wherein said servo control comprises an electrical system.

10. A leeway angle measuring apparatus for use in conjunction with a moving vessel, comprising:

an elongate vane assembly having a submersible vane member at one thereof;

first bearing means coupled to said vane assembly for allowing said vane to rotate upon a first axis;

indicating means coupled to said vane assembly for indicating the angular position of said vane member;

second bearing means rotatably carrying said first bearing means for allowing said first bearing means and said vane to rotate about a second axis lying generally perpendicular to said first axis; and attitude control means coupled to said first bearing means for maintaining the plane defined by said first and said second axis substantially vertical.

11. An apparatus according to claim 10, wherein said attitude control system comprises a servo system including a true vertical reference means and motive means.

12. Apparatus according to claim 11, further including speed sensing means for determining the relative velocity of said vane when immersed in water.

13. Apparatus according to claim 12, further including means for determining the heel angle between said vane and a vessel carrying said apparatus.

* * * * *